US005310365A

United States Patent [19]

Hashimoto

[11] Patent Number: 5,310,365

[45] Date of Patent: May 10, 1994

[54] TERMINAL CONNECTING DEVICE

[75] Inventor: Hiroo Hashimoto, Tokyo, Japan

[73] Assignee: Yukio Hashimoto, Tokyo, Japan

[21] Appl. No.: 706

[22] Filed: Jan. 5, 1993

[30] Foreign Application Priority Data

Jan. 17, 1992 [JP] Japan ..... 4-010246[U]

[51] Int. Cl.[5] ..... H01R 11/01

[52] U.S. Cl. ..... 439/756; 439/764

[58] Field of Search ..... 439/756, 761–762, 439/764–766, 788, 805, 810, 815

[56] References Cited

U.S. PATENT DOCUMENTS

| | | | |
|---|---|---|---|
| 1,802,381 | 4/1931 | Hofbauer | 439/756 |
| 3,205,472 | 9/1965 | Shannon | 439/764 |
| 3,369,215 | 2/1968 | Haegert | 439/764 |
| 3,588,790 | 6/1971 | Shannon | 439/764 |

FOREIGN PATENT DOCUMENTS

| | | | |
|---|---|---|---|
| 0793121 | 1/1936 | France | 439/756 |
| 0795503 | 3/1936 | France | 439/756 |
| 1280276 | 11/1961 | France | 439/756 |
| 0435705 | 9/1935 | United Kingdom | 439/756 |

*Primary Examiner*—Paula A. Bradley

*Attorney, Agent, or Firm*—Griffin, Butler, Whisenhunt & Kurtossy

[57] ABSTRACT

A connecting member 1 for achieving electric conduction is composed of a contacting and surrounding portion 2 for surrounding a battery terminal B, right and left holding portions 3 confronting each other, and elastic force applying portion 5 having end surfaces to be abutted against each other. A connecting bolt 6 to be inserted into the holding portions 3 is split into two portions connected to each other, i.e. half-split members 6A and 6B and recessed inserting grooves 7 for holding a cable C and engaging means 8 to be meshed each other are defined on the surfaces of the half-split members 6A and 6B. The connecting bolt 6 is inserted into the inserting grooves 4 from the one side of the holding portions and a hut 10 is tightened to the male portion of the connecting bolt 6 projecting from the other side thereof and the cable C is fixed to an outside of the holding portions 3. With this arrangement, the cable C is easily inserted and stably fixed and has strong rigidity and thus a mounting job can be simply and securely performed.

4 Claims, 2 Drawing Sheets

TERMINAL CONNECTING DEVICE

BACKGROUND OF THE INVENTION

1. Field of the Invention

The present invention relates to a terminal connecting device for very simply making connection to the terminal of, for example, a car battery.

2. Description of the Related Art

Conventionally, these kinds of terminal connecting devices for a car battery are arranged such that, for example, a connecting member formed substantially to an ohm-character shape is disposed to surround a battery terminal and the end portions of the connecting member are tightened by bolts and nuts. Then, a cable end is connected to the male screw portion projecting from the connecting member and tightened by a butterfly nut. At this time, a connecting terminal having a through hole is connected to the cable end by caulking, welding or the like and the through hole of the connecting terminal is engaged with the above male screw portion.

Further, a cable is fixed by making use of a tightening action of bolt and nut in such a manner that a cable end is inserted into the inserting portion of an opening defined to a bolt itself and the cable is fixed by being strongly tightened by a nut tightened to the screw portion of the bolt. For example, refer to the specification of Japanese Utility Model Registration No. 25547, Japanese Utility Model Publication Nos. Sho 2-5180, Sho 35-26653, Sho 37-19755 and the like, and further to Japanese Utility Model Publication No. Hei 3-13969 proposed by the applicant.

Nevertheless, according to the above conventional connecting devices, since a connecting terminal is connected to a cable end beforehand, a thin plate-shaped electric conductive sheet terminal cut substantially to a flat T-shape must be prepared and the opposite ends thereof must be caulked to bundle a cable wire and connected thereto. Moreover, in a connecting job, the connecting member must be connected to a battery terminal by bolt and nut and further butterfly nuts must be tightened to the male screw portion of the connecting terminal at two positions. This job is very time-consuming and the arrangement of the connecting devices is complex and expensive.

Further, since the conventionally proposed structures tightened by bolt and nut disclosed in the above publications have a bolt with a hole into which a cable is inserted, unless the twisted thin wires of a cable end are brought together (in the case that the cable is composed of the twisted thin wires), the cable cannot be smoothly inserted into the hole and thus a connecting job is time-consuming. In addition to the above, since various small parts are assembled for the wire to be connected and fixed, the structures are complex and expensive and the handling thereof is very troublesome.

Further, since the terminal connecting device disclosed in Japanese Utility Model Publication No. Hei 3-13969 proposed by the applicant has a bolt having a male screw portion to which a groove-shaped inserting portion is defined and this portion is inclined with respect to the axial center of the bolt, it is found that a cable can be easily inserted into the inserting portion and stably fixed under pressure, whereas the cable does not have a sufficient strength and may be broken by an external impact or the like. Further, in addition to the above problem, when a strand cable composed of thin wires is inserted into the inserting portion, these thin wires may be caught by the opening edge of the inserting portion and not be smoothly inserted thereinto.

Thus, taking the above into consideration, an object of the present invention is to provide a terminal connecting device having a simple structure and capable of being easily mounted, and by use of which not only can the cable be easily inserted and held so that working efficiency can be improved, but also the cable can be stably fixed with sufficient strength.

DESCRIPTION OF THE INVENTION

Figure 1:
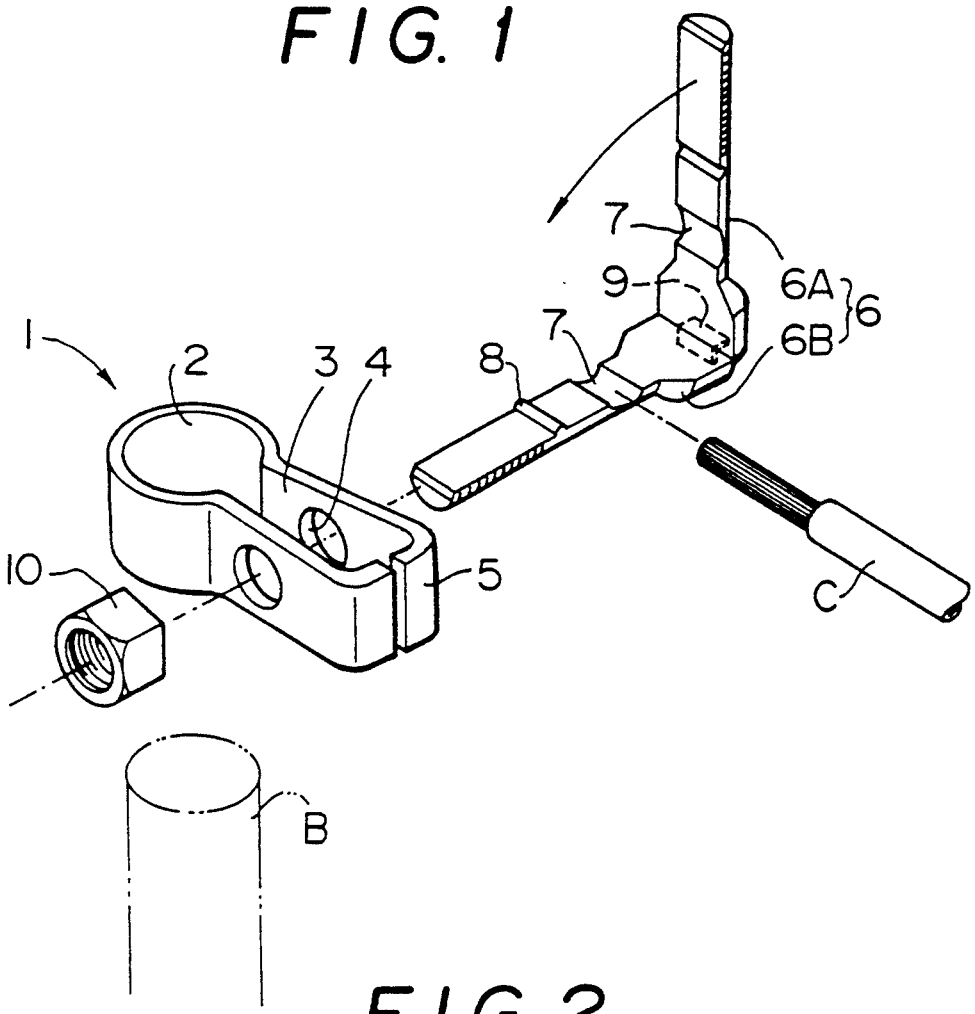
FIG. 1 is an exploded perspective view of a terminal connecting device in use.

To achieve the above object, according to the present invention, there is provided a terminal connecting device which comprises a connecting bolt 6 inserted into a connecting member 1 electrically connected to a battery terminal B and tightened to the connecting member by a nut, the connecting bolt 6 being composed of a pair of half-split members 6A, 6B split in the axial direction of the connecting bolt and a recessed inserting groove 7 defined to the surface of each of the half-split members to hold a cable C.

Further, the half-split members 6A, 6B are connected to each other by a flexible connecting means 9.

Further, the half-split members 6A, 6B may include engaging means 8 formed on the surfaces thereof and the engaging means are meshed to each other to align the half-split members 6A, 6B.

Further, the connecting member 1 is arranged such that right and left holding portions 3 extend in confrontation to each other from the opposite ends of contacting and surrounding portion 2 surrounding the battery terminal B and each of the holding portions 3 has a hole 4 defined through it to enable the connecting bolt 6 to be inserted therethrough and an elastic force applying portion 5 is continuously formed by bending the ends of the holding portions 3 in the closing direction to cause the opposite ends of the elastic force applying portion 5 to be abutted against each other.

According to the terminal connecting device of the present invention, the connecting member 1 is mounted to a member to be electrically connected, e.g., the battery terminal B to surround the terminal B by the contacting and surrounding portion 2, whereas the cable C is inserted into the inserting grooves 7 of the connecting bolt 6.

At this time, the connecting bolt 6 is composed of the half-split members 6A and 6B split into the two portions in the axial direction of the bolt. Since the inserting groove 7 is defined by the surface of each of the half-split members 6A and 6B, when the half-split members 6A. 6B are opened and separated, the inserting grooves can be greatly opened and exposed. The half-split members 6A, 6B hold the cable C therebetween through the exposed inserting grooves 7 and fix the cable therein.

Further, the engaging means 8 formed to each of the half-split members 6A, 6B serves as a mark for aligning them and when the engaging means 8 are with each other, the connecting bolt 6 is integrally formed, and thus while the half-split members 6A an 6B are tightened by a nut, they are not separated from each other.

The connecting bolt 6 having the cable C held in it is inserted into the connecting member 1, and when the nut is tightened to it, the connecting bolt 6 is gradually advanced toward the connecting member 1 to thereby strongly fix the cable C inserted into the inserting grooves 7 to an outside surface of the connecting members 1.

The right and left holding portions 3 of the connecting member 1 are caused to approach to each other by the tightening action of the nut 10. At this time, since the elastic force applying portion 5, having the end surfaces abutted against each other, regulates the movement of the holding portions 5, and the contacting and surrounding portion 2 is bent. As a result, the contacting and surrounding portion 2 causes the connecting member 1 to nicely come into contact with the circumference of the battery terminal B.

DESCRIPTION OF PREFERRED EMBODIMENTS

An embodiment of the present invention will be described below with reference to the drawings. This embodiment shows an example of electric conduction effected through a connecting member 1 as a member to be connected which is used for the connection with, for example, the terminal B of a car battery.

The connecting member 1 as the member to be connected shown in FIG. 1 includes a contacting and surrounding portion 2, holding portions 3 and elastic force applying portion 5 and is formed by bending a band-shaped electric conductive member having a suitable thickness.

More specifically, the contacting and surrounding portion 2 is formed to an arc-shape a little longer than a semicircle when viewed in a plan view so that it surrounds, for example, the projecting portion with a circular cross section of the battery terminal B. A pair of the right and left holding portions 3 extend in confrontation to each other from the opposite ends of the contacting and surrounding portion 2 and each of the holding portions 3 has a hole 4 through it to enable a connecting bolt 6 to be inserted therethrough. The elastic force applying portion 5 is formed by being bent from the ends of the holding portions 3 in the direction to cause the opposite ends of the elastic force applying portion 5 to face to each other so that the ends of the portion 5 can be abutted against each other. The holding portion 3 is flexed inwardly by a holding action applied from the outside by the abutment of the ends of the elastic force applying portion 5. As a result, the contacting and surrounding portion 2 can securely surround the battery terminal B.

The holding action to the right and left holding portions 3 can be performed by the connecting bolt 6 and a tightening nut 10. The holding portions 3 are tightened to each other in such a manner that the connecting bolt 6 is caused to pass through the holding portions 3 by being inserted from one of the holding portions 3 and projecting from the other holding portion 3 and the nut 10 is tightened to the male screw portion of the bolt 6 projecting from the other holding portion 3.

At this time, an electric connection to the battery terminal B is performed by a predetermined cable C connected to the connecting bolt 6. For this purpose, the connecting bolt 6 is composed of a pair of half-split members 6A and 6B obtained by splitting the connecting bolt 6 into two portions along the axis thereof. An inserting groove 7 is recessed to the split surface of each of the half-split members 6A and 6B, and further each of the half-split surfaces 6A and 6B has an engaging means 8 to be meshed with each other so that the half-split members 6A, 6B can be aligned to each other.

The half-split members 6A and 6B are obtained by splitting a hexagon headed bolt integrally composed of a head portion and male screw portion into two portions in an axial direction at the ridge portion or flat portion of the head, and when both half-split portions 6A and 6B are aligned to each other, the helical grooves of the male screw portion are substantially continuously formed so that the nut 10 can be tightened to it. Of course, the half-split members 6A and 6B may be independently formed and then a male screw is threaded to each of them.

As shown in FIG. 1, the inserting grooves 7 are symmetrically recessed to the split surfaces of the half-split members 6A and 6B and disposed to the base side of the male portion or from the base portion to the head portion of the male screw portion. Thus, when the half-split portions 6A and 6B are aligned to each other, a hole-shaped void is defined to completely accommodate the thin wires of the cable C inserted thereinto.

One of the engaging means 8 is composed of a projecting portion in the split surface of one of the half-split members 6A and 6B and the other part of the engaging portions 8 is composed of a recessed portion in the other half-split member so that they are meshed with each other. These portions are formed, for example along the diametrical direction of the male screw portion as shown in FIG. 1, along an axial direction although not shown, or composed of a recessed portion and a projecting portion symmetrically formed to the two split surfaces. In short, the specific configuration of the engaging means 8 is not particularly limited so long as the helical groove of the male screw portion of the half-split member 6A is continuous to that of the half-split member 6B.

Note, the connecting bolt 6 may be composed of iron, brass, synthetic resin or the like and the material thereof is not particularly limited.

Figure 2:
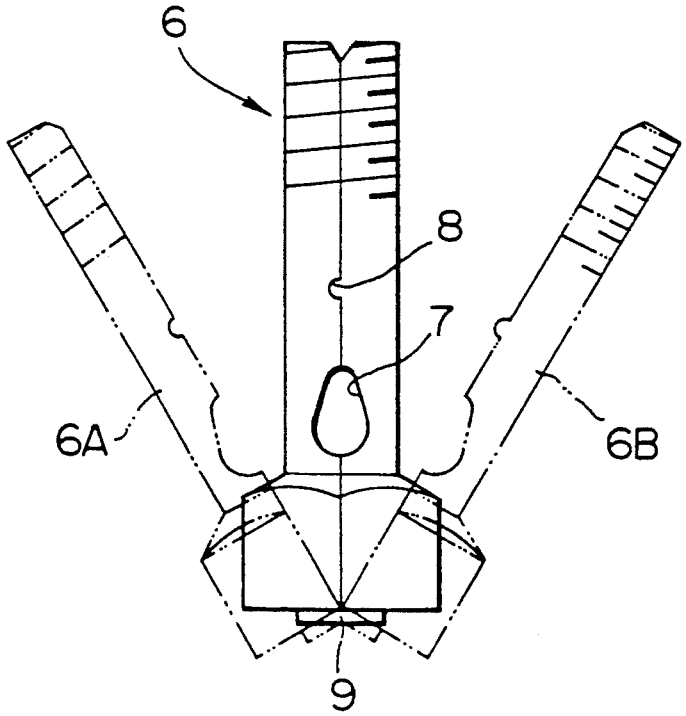
FIG. 2 is a side view of a connecting bolt.
Figure 3:
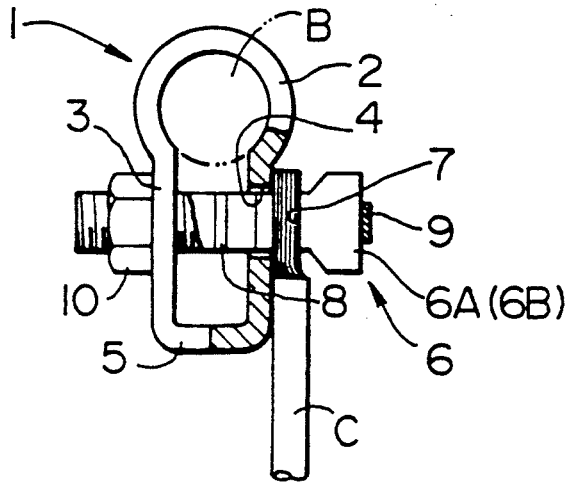
FIG. 3 is a plan view, partly in cross section, of the terminal connecting device in use.

Further, in FIGS. 1 to 3, the half-split members 6A and 6B are connected to each other by a flexible connecting means 9 to make them a pair. For example, the connecting means 9 is arranged such that the opposite ends of a synthetic resin band piece is adhered to the upper surfaces of the head portions of the half-split members 6A and 6B or tightened thereto by screws. As shown in the figures, when this kind of the swingingly openable and closable type connecting structure is employed, the holding and inserting jobs of the cable C to the half-split members 6A and 6B can be more smoothly performed by chamfering and inclining the ends of the two split surfaces.

Figure 4:
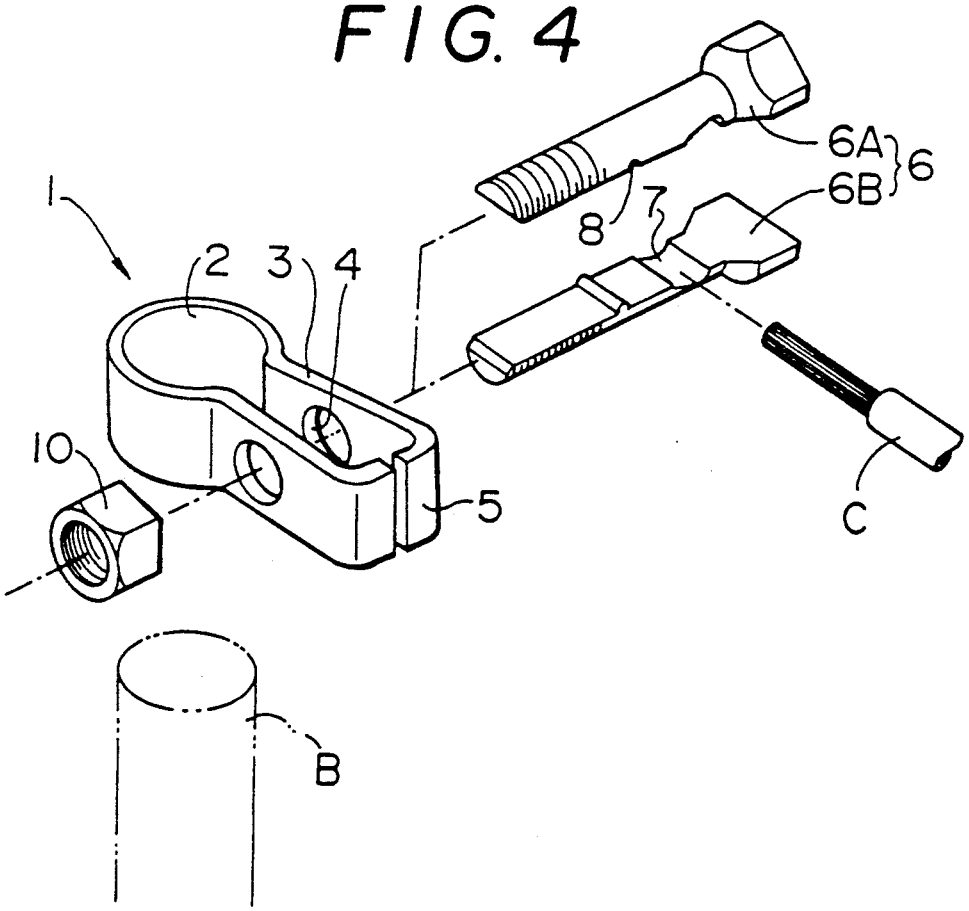
FIG. 4 is an exploded perspective view of the terminal connecting device of another embodiment in use.

The half-split members 6A and 6B shown in FIG. 4 are separately arranged and made to a pair by being connected through the engaging means 8 when used to connect the cable C.

Next, an example in which the half-split members 6A and 6B are used will be described. First, the connecting member 1 is engaged with the battery terminal B through the contacting and surrounding portion 2, whereas the cable C is inserted into the inserting grooves 7 of the connecting bolt 6.

At this time, the cable C is inserted into the inserting grooves 7 in such a manner that the split surfaces of the half-split members 6A and 6B are separated to greatly open the inserting grooves 7. More specifically, when the half-split members 6A and 6B are connected by the connecting means 9 as shown in FIG. 1, the cable C is positioned in the inserting grooves 7 exposed by flexing the connecting means 9, and further when the half-split members 6A and 6B are separately arranged as shown in FIG. 4, the cable C is inserted into the inserting grooves 7 by holding it at the position of the inserting grooves 7.

Next, the connecting bolt 6 is inserted into the holding portions 3 extending from the opposite ends of the contacting and surrounding portion 2 from one side thereof to the other side and the nut 10 is tightened to the male screw portion of the connecting bolt 6 projecting from the other side of the holding portions 3. As the nut 10 is tightened, the connecting bolt 6 is moved toward the tightening screw 10 so that the cable C inserted into the inserting grooves 7 is strongly pressed against an outside surface of the holding portions 3.

At this time, the right and left holding portions 3 are caused to approach to each other by the tightening action of the nut 10. At this time, since the elastic force applying portion 5 having the end surfaces abutted against each other regulates the movement of the holding portions 5 at one end thereof, the portions continuous to the contacting and surrounding portion 2 at the other end of the holding portions 3 are caused to approach to each other and be flexed. As a result, the connecting member 1 nicely comes into contact with the circumference of the battery terminal B through the contacting and surrounding portion 2.

Since the present invention is arranged as described above, a conventional time-consuming job and processing such as tightening of screws at two positions, caulking of the cable C to a connecting terminal, and the like are not needed. Further, a troublesome insertion job of the cable C through the opening of a narrow inserting groove is not needed and the cable C can be very easily inserted into and positioned at the largely opened inserting grooves 7 and thus an electrically connecting job can be effectively carried out.

More specifically, this can be achieved by the arrangement comprising a connecting bolt 6 inserted into and tightened by a nut a connecting member 1 electrically connected to a battery terminal B and tightened to the connecting member by a nut, the connecting bolt being composed of a pair of half-split members 6A, 6B split in the axial direction of the connecting bolt and recessed inserting grooves 7 defined to the surface of each of the half-split members to hold a cable C, and thus the cable C can be very easily inserted into the inserting grooves 7 by this arrangement.

Further, the connecting member 1 is arranged such that the right and left holding portions 3 extend in confrontation to each other from the opposite ends of contacting and surrounding portion 2 surrounding the battery terminal B and each of the holding portions 3 has a hole 4 through it to enable the connecting bolt 6 to be inserted therethrough and an elastic force applying portion 5 is continuously formed by bending the ends of the holding portions 3 in the closing direction to cause the opposite ends of the elastic force applying portion 5 to be abutted against each other and the connecting bolt 6 is inserted into the connecting member 1 and tightened thereto by the nut. As a result, one position need only be tightened by the nut and further the connection of the cable terminal C to the connecting bolt 6 and the connection of the connecting member 1 to the battery terminal B can be simultaneously effected by the tightening operation of the nut. More specifically, the cable C can be connected to the battery terminal B by such simple jobs that the engagement of the connecting member 1 to the battery terminal B, the insertion of the cable C into the inserting grooves 7, and the tightening operation of the nut 10 to the connecting bolt 6.

In particular, since the inserting groove 7 defined to each of the half-split members 6A, 6B formed by splitting the connecting bolt 6 into the two portions is formed on the split surface of each half-split member, the inserting grooves 7 are greatly exposed when the half-split members 6A, 6B are opened and separated from each other so that the half-split members 6A, 6B can be disposed to hold the cable C therebetween, and thus even if the cable C is composed of, for example, a strand cable including thin wires not bundled, the cable C can be easily inserted into the inserting grooves 7.

Further, the engaging means 8 formed to each of the half-split members 6A, 6B serves as a mark for aligning them, and when the engaging means 8 are meshed each other, the half-split members 6A and 6B are formed to the single connecting bolt 6 and thus when the connecting bolt 6 is tightened by the nut, the half-split members 6A and 6B are not separated from each other and thus a tightening operation can be carried out in a usual manner.

Further, as the nut 10 is tightened in the state that the nut 10 is contact with the outside surface of one of the holding portions 3, the connecting bolt 6 is moved toward the tightening nut 10 so that the cable C is securely fixed to the outside surface of the other holding portion 3 and strongly fixed without being removed.

Further, the elastic force applying portion 5 of the holding portions 3 extending from the opposite sides of the contacting and surrounding portion 2 is abutted against each other, it is flexed inwardly by the holding action effected from the outside by the tightening nut 10 at the holding portions 3 and a spring effect is achieved by the flexing action. As a result, the contacting and surrounding portion 2 securely surrounds the battery terminal B and is stably fixed to it without being removed by shock or vibration applied from the outside.

Further, the present invention can be applied not only to the detachable connection to the terminal of a car battery effected by using the connecting member 1 but also to an electrically connecting structure tightened by screws such as, for example, the connecting structure of a booster cable to a clip and other various kinds of electric parts and thus has a wide application.

As described above, since the terminal connecting device according to the present invention does not require a conventionally used butterfly nut and sheet terminal, it can be simply mounted and has improved workability, mounting stability and strong rigidity as well as is less expensive, and thus achieves a very useful effect in a practical use.

As described above, according to the terminal connecting device of the present invention, since the device does not require a butterfly-nut and sheet terminal needed by prior art and can be handled easily with a simple structure, it can achieve very useful effects in practical use such as that not only the device can be stably mounted in a simple manner and has strong rigidity and improved working efficiency but also can be provided at a low cost.

What is claimed is:

1. A terminal connecting device for connecting an electrical cable to a battery terminal, comprising:

(1) a connecting member having a connecting and surrounding portion for at least partially surrounding the battery terminal and connecting the cable thereto, said connecting member having first and second spaced-apart holding portions extending from the connecting and surrounding portion and each holding portion having a bolt receiving hole therethrough;

(2) a connecting bolt receivable through said bolt receiving holes and having:

(a) a pair of opposed half-split members which are split in an axial direction of the bolt so as to form inner and outer surface of each half-split member along an entire axial length of the bolt;

(b) a recessed inserting groove disposed on the inner surface of each half-split member such that the grooves in combination form a cable receiving hole through the half-slit members, said cable receiving hole extending in a direction transverse to the axial direction of the bolt; and (c) thread means on the outer surfaces of the half-split members for threadedly engaging a nut such that upon insertion of the bolt with a cable received in the cable receiving hole through the bolt receiving holes and tightening the nut, the cable is clamped between the half-split members and the connecting and surrounding portion is clamped against the battery terminal.

2. A terminal connecting device according to claim 1, wherein said half-split members are connected to each other by a flexible connecting means.

3. A terminal connecting device according to claim 1, wherein said half-split members include engaging means formed on the inner surfaces thereof and said engaging means are meshable with each other to align said half-split members.

4. A terminal connecting device according to claim 1, wherein the holding portions extend in confrontation to each other and an elastic force applying portion is formed at the ends thereof and in directions to cause opposite ends of said elastic force applying portion to abut against each other.

* * * * *